US008066014B2

(12) United States Patent
Deris

(10) Patent No.: US 8,066,014 B2
(45) Date of Patent: Nov. 29, 2011

(54) MULTI-FUNCTIONAL HAIRBRUSH WITH STORAGE COMPARTMENTS

(76) Inventor: Mitra M. Deris, Brentwood, CA (US)

( * ) Notice: Subject to any disclaimer, the term of this patent is extended or adjusted under 35 U.S.C. 154(b) by 497 days.

(21) Appl. No.: 12/202,104

(22) Filed: Aug. 29, 2008

(65) Prior Publication Data

US 2010/0050352 A1 Mar. 4, 2010

(51) Int. Cl.
*A45D 24/00* (2006.01)

(52) U.S. Cl. ..... 132/102; 132/148; 132/121; 132/297; 132/313; 15/105

(58) Field of Classification Search ..... 132/212, 132/102, 147, 131, 313, 121, 145, 286, 148; 211/120; 206/214, 581, 480, 385, 340–341
See application file for complete search history.

(56) References Cited

U.S. PATENT DOCUMENTS

| | | | | |
|---|---|---|---|---|
| 1,390,332 | A * | 9/1921 | Bethincourt | 132/312 |
| 1,991,867 | A * | 2/1935 | Riciputi et al. | 132/313 |
| 2,097,938 | A * | 11/1937 | Sundin | 132/121 |
| 2,269,940 | A * | 1/1942 | Johnson | 312/205 |
| 2,363,647 | A * | 11/1944 | Cosin | 206/362.3 |
| 2,800,048 | A * | 7/1957 | Anderson | 84/95.2 |
| 5,012,831 | A * | 5/1991 | Canela | 132/313 |
| 5,320,125 | A * | 6/1994 | Barnhart | 132/313 |

FOREIGN PATENT DOCUMENTS

JP 11046855 * 2/1999

OTHER PUBLICATIONS

Translation of Abu K reference.*

* cited by examiner

*Primary Examiner* — Todd Manahan
*Assistant Examiner* — Brianne O'Neill
(74) *Attorney, Agent, or Firm* — Ray K. Shahani, Esq.; Kin H Lai

(57) ABSTRACT

A multi-functional hairbrush with storage compartments for grooming, storing and organizing small beauty accessories, the hairbrush having a hollow brush head and main chamber, a brush lid portion attached hingedly to the hollow brush head, a plurality of spring clips mounted removably therewithin. The hairbrush also has a slot chamber positioned underneath the main chamber and a flat comb portion fitting within the slot chamber and inserted removably therewithin. The hairbrush has a hollow, elongated handle portion and an elongated chamber, with handle lid portion attached hingedly to the handle portion. The elongated chamber also as a plurality of spring clips mounted removably therewithin.

9 Claims, 5 Drawing Sheets

MULTI-FUNCTIONAL HAIRBRUSH WITH STORAGE COMPARTMENTS

FIELD OF THE INVENTION

This invention relates to a multi-functional hairbrush for hair and beauty professionals, and more particularly, to a flat hairbrush that has multiple compartments and holders for storage of various styling and beauty devices and accessories.

BACKGROUND OF THE INVENTION

Conventional hairbrushes are formed as an elongated member typically including a handle portion and a head portion. Commonly, the head portion further consists of a bristle segment in which numerous bristles are inserted into a substantially flat structure. Hairbrushes are preferred by lots of hairdressers, beauty professionals and regular customers alike. In many cases, users may need a variety of beauty accessories such as combs, lipsticks, mascaras, a mirror etc., at the same time.

There is a need in the marketplace for an all-in-one hairbrush that also provides easy to use storage spaces for beauty accessories. Beauty professionals and end users alike can simply store and carry the hairbrush, and their various grooming needs can be fulfilled. Also, the storage compartments in the hairbrush helps organize those beauty accessories that are usually smaller in size.

Additionally, the storage compartments concept can also be applied to other brushes such as brushes for clothes, cleaning brushes, sanding brushes, etc.

ADVANTAGES AND SUMMARY OF THE INVENTION

The present invention is a multi-functional hair brush that has multiple compartments for storage of beauty accessories.

One object and advantage of the present invention is to provide an all-in-one hair care and beauty tool. It is especially beneficial to beauty professionals such as hair stylists who need to carry their tools with them. Portability is enhanced.

Another object and advantage of the present invention is to help organize numerous small-sized beauty accessories and make up products such as mascara, tweezers, etc.

Another object and advantage of the present invention is its ability to transport, store and organize beauty tools that come in different sizes and shapes in a compact structure. Users can easily pack and travel with the present invention and have everything for their grooming needs.

Another object and advantage of the present invention is its adaptability to other brushes such as cleaning brushes, sanding brushes, brushes for clothes, etc. The storage compartments can be utilized to organized other small objects.

Further details, objects and advantages of the present invention will become apparent through the following descriptions, and will be included and incorporated herein.

DETAILED DESCRIPTION OF THE PREFERRED EMBODIMENT

Figure 1A:
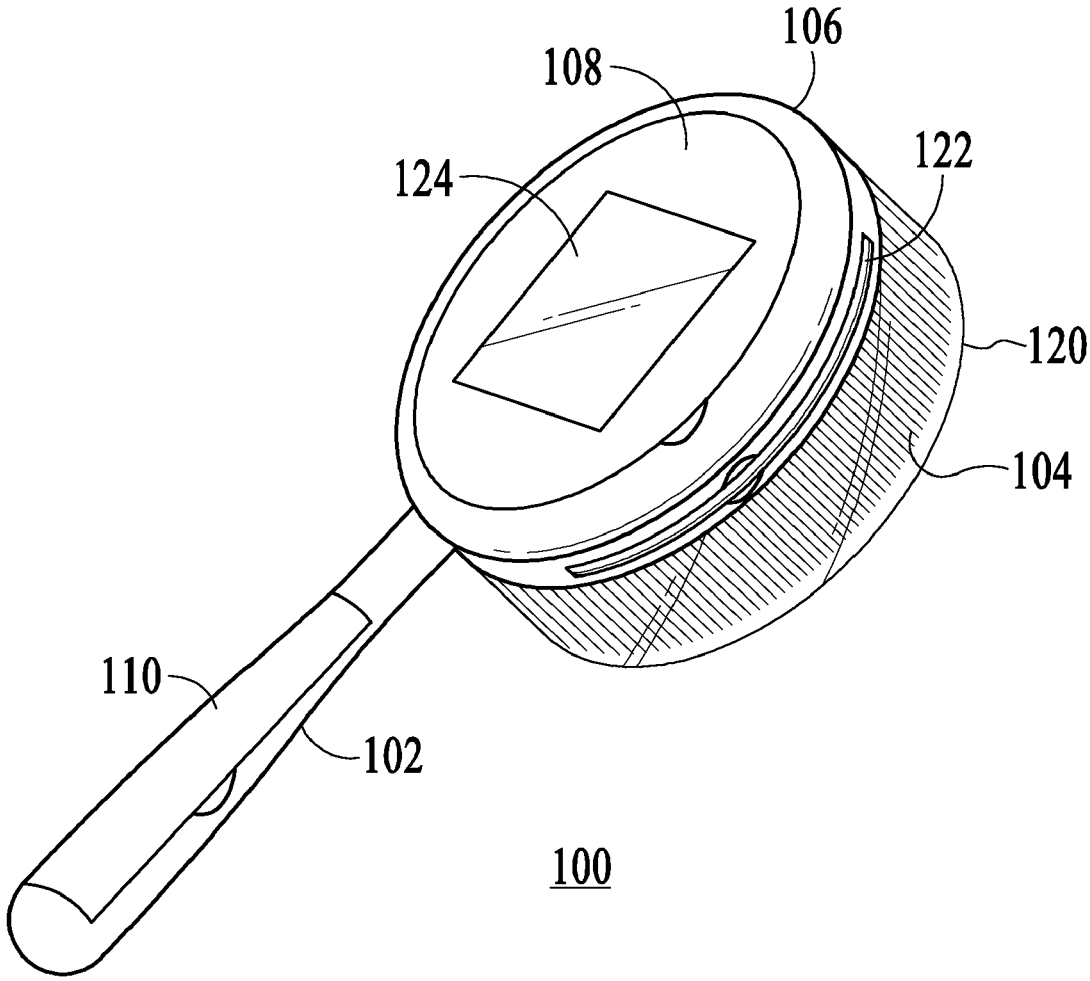
FIG. 1A is a representative isometric view of an embodiment of the multi-function hairbrush with storage compartments 100 of the present invention.

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

It will be understood that in the event parts of different embodiments have similar functions or uses, they may have been given similar or identical reference numerals and descriptions. It will be understood that such duplication of reference numerals is intended solely for efficiency and ease of understanding the present invention, and are not to be construed as limiting in any way, or as implying that the various embodiments themselves are identical.

Figure 1B:
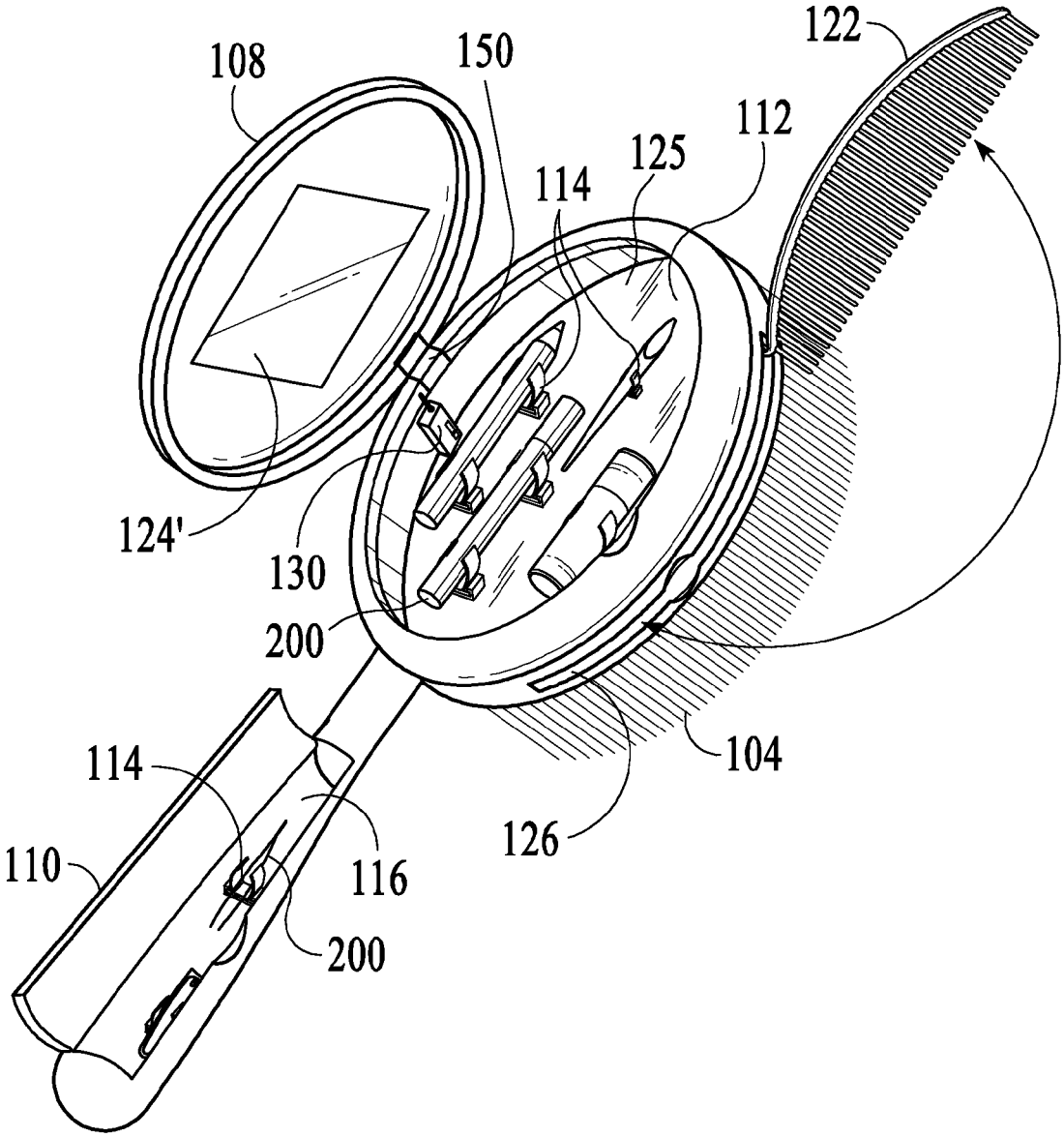
FIG. 1B is a representative isometric view of an embodiment of the multi-function hairbrush with storage compartments 100 of the present invention showing storage compartments 112 and 116.

FIG. 1A is a representative isometric view of an embodiment of the multi-function hairbrush with storage compartments 100 of the present invention. FIG. 1B is a representative isometric view of an embodiment of the multi-function hairbrush with storage compartments 100 of the present invention showing storage compartments 112 and 116.

As shown in FIG. 1A, the multi-function hairbrush with storage compartments 100 of the present invention takes the shape of a traditional flat brush which consists essentially of brush head portion 106, handle portion 102 and brush cover 120. In one embodiment, brush head portion 106 is a flat and hollow structure in a variety of shape such as oval, circular, square, etc.

As in the traditional hairbrush, brush head portion 106 further comprises numerous bristles 104 attached mechanically on one of the flat surfaces of brush head portion 106. In one embodiment, bristles 104 are made from either natural materials such as Kolinsky sable and ox hair (sabeline) or synthetic materials such as special multi-diameter extruded nylon filament. As shown in FIG. 1A, brush cover 120 is a transparent or translucent bowl like structure and its main function is to protect bristles 104 when the present invention 100 is not in use. Brush head door 108 is a door opened to the hollow open compartment space 112 inside brush head portion 106 and is attached mechanically onto brush head portion 106 with a door hinge 150. Optionally, brush mirror 124 can be installed on the outside of brush head door 108 for grooming purposes. Also optionally, brush mirror 124 can be easily replaced by a decorative plate or even a business logo for advertising purposes.

In one embodiment, handle portion 102 is an elongated hollow structure with one end coupled mechanically to brush head portion 106. Optionally, handle portion 102 may have a cross-sectional shape of an oval, circle, square, etc. Handle door 110 is a contoured door opened to the hollow open compartment space 112 inside handle portion 102 and is attached mechanically on handle portion 102 with a door hinge 150. In one embodiment, handle door 110 has a contoured shape conforming to the shape of handle portion 102.

As shown in FIG. 1B, when brush head door 108 is opened, it reveals head storage compartment 112 inside the hollow brush head portion 106. In one embodiment, a music box movement 130 is installed near door hinge 150 such that when brush head door 108 is opened, it will trigger music box movement 130 and music will be played. Optionally, music box movement 130 can be switched off permanently with a simple on/off switch (not shown) to avoid music playing every time brush head door 108 is opened.

Figure 4:
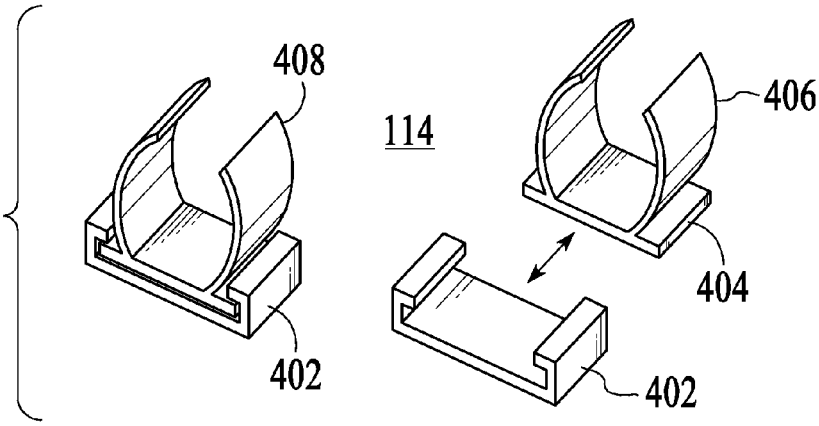
FIG. 4 is a representative isometric view of removable accessory clip 114 of the multi-function hairbrush with storage compartments 100 of the present invention.

As best shown in FIGS. 1B and 4, a plurality of removable accessory clips 114 are installed on the inside of head storage compartment 112. The clips 114 are installed inside the opening 112 such as on the flat, inside surface 125.

The details of removable accessory clips 114 are best shown in FIG. 4. Removable accessory clips 114 each further comprises a base flange 402 and a circlip insert 408. Base flanges 402 of removable accessory clips 114 are installed or adhered inside of head storage compartment 112. When required, circlip inserts 408 can be coupled on base flanges 402 to complete the structure of removable accessory clips 114. In one embodiment, each circlip insert 408 further comprises a circlip portion 406 formed integrally with a base insert portion 404. Dimensions of base insert portion 404 are standard and should match those on the base flange 402. Circlip portion 406 acts as a snap ring or pinch clamp and comes in different sizes to accommodate different objects 200. The purpose of the circlip portion 406 is to provide a temporary grip on accessories or objects 200 such as eyeliners, mascaras, lipsticks, etc. Users can select circlip inserts 408 of ideal sizes for each object 200. By selecting circlip inserts 408 of various sizes and inserting them in selected base flanges 402, users can organize the entire head storage compartment 112 the way it is desired. Users can also optionally remove all circlip inserts 408 and utilize the open head storage compartment 112 to hold small objects such as small jewelry, coins, etc.

Optionally, brush mirror 124' can be installed on the inside of brush head door 108 for grooming purposes. Also optionally, brush mirror 124' can be easily replaced by a decorative plate or even a business logo or a message for advertising and gift giving purposes.

As shown in FIG. 1B, handle door 110 opens to an elongated handle storage compartment 116 inside the hollow handle portion 102; within which there are a plurality of removable accessory clips 114. The function and structure of handle storage compartment 116 is very similar to head storage compartment 112 except for the more elongated space available which is more suitable to accommodate long objects 200 such as nail clippers, tweezers, etc.

As shown in FIG. 1B, a comb slot 126 is located on the side of brush head portion 106 underneath the storage compartment 112. Detachable comb 122 is extended and stowed inside the comb slot 126 through a pivot point mechanism resembling a foldable pocket knife. In one embodiment, detachable comb 122 is attached to the comb slot 126 at detachable hinge 202, as best shown in FIG. 1D, so detachable comb 122 can be taken out, removed from the hairbrush 100 and used separately.

Figure 1C:
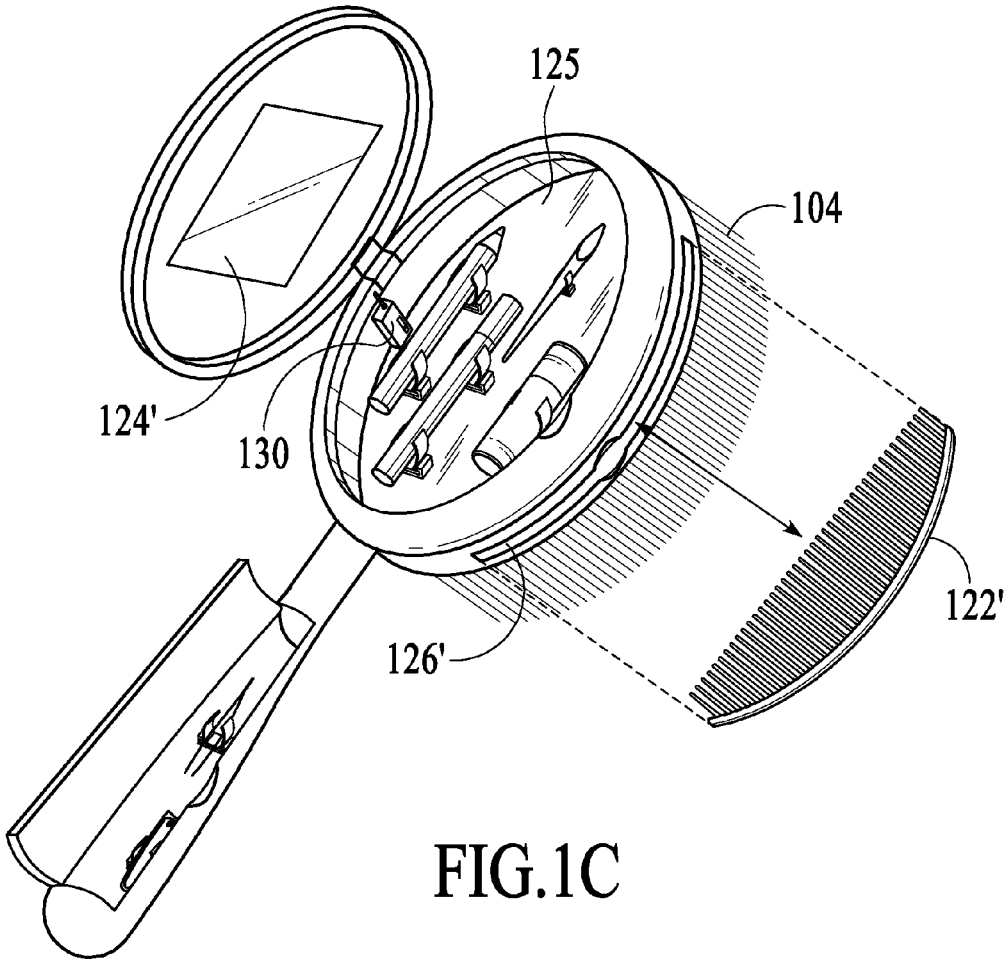
FIG. 1C is an a representative isometric view of another embodiment of the multi-function hairbrush with storage compartments 100 of the present invention showing storage compartments 112 and 116.
Figure 1D:
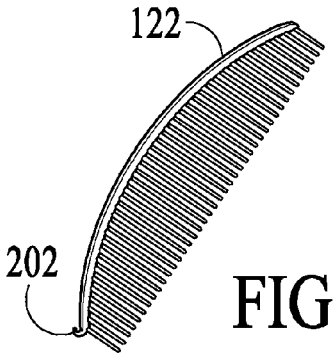
FIGS. 1D and 1E are representative top views of alternative embodiments of detachable combs 122 and 122'.
Figure 1E:
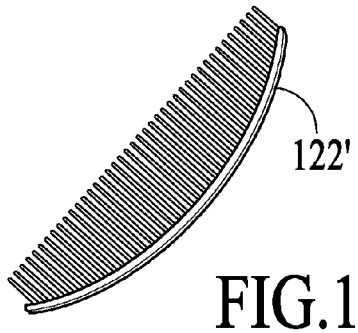

FIG. 1C is a representative isometric view of another embodiment of the multi-function hairbrush with storage compartments 100 of the present invention showing storage compartments 112 and 116. Instead of using the pivot point mechanism, detachable comb 122' does not have a detachable hinge 202, as best shown in FIG. 1E, and is simply inserted and stored inside comb slot 126' when it is not in use.

Figure 2A:
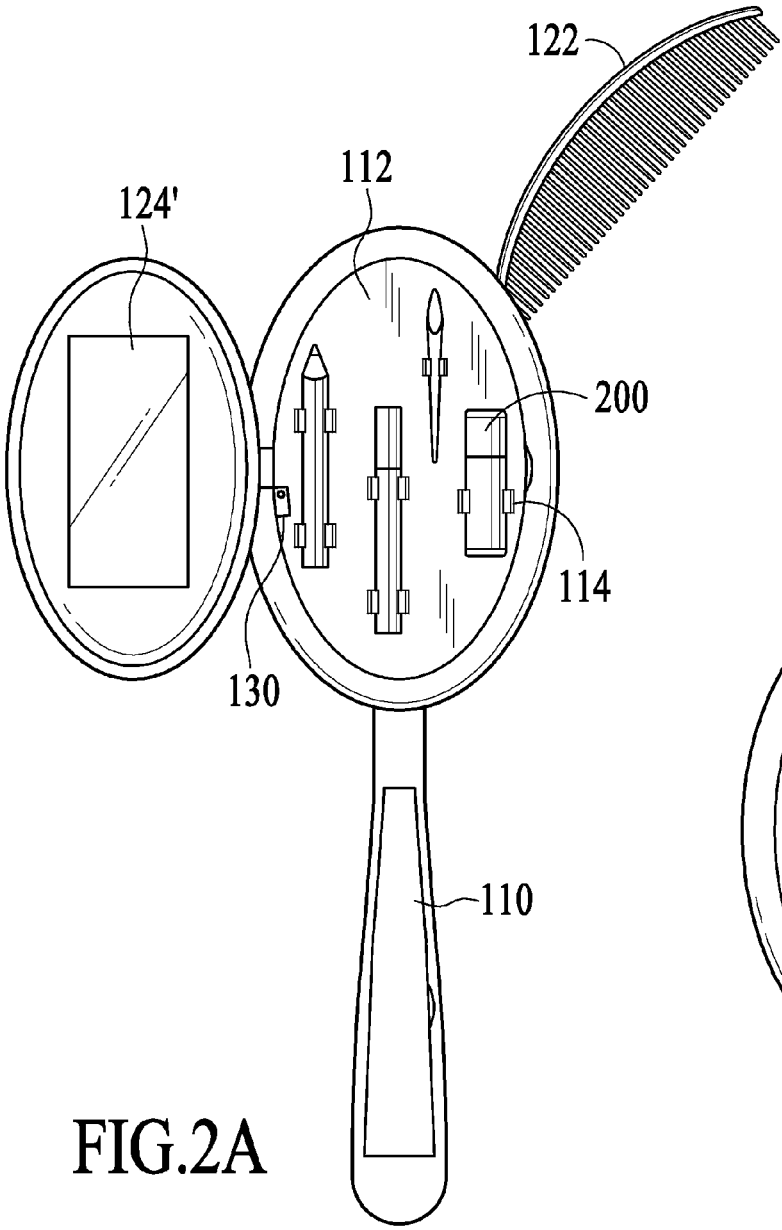
FIG. 2A is a representative top view of an embodiment of the multi-function hairbrush with storage compartments 100 of the present invention showing detachable comb 122 in the open mode.
Figure 2B:
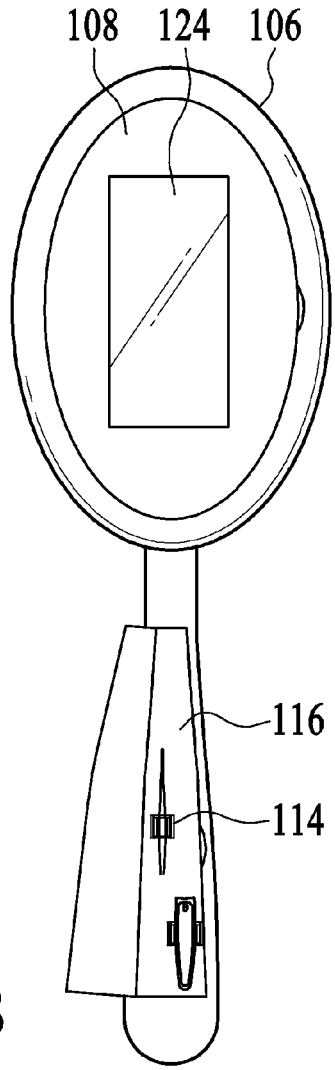
FIG. 2B is a representative top view of an embodiment of the multi-function hairbrush with storage compartments 100 of the present invention showing storage compartment 116.

FIG. 2A is a representative top view of an embodiment of the multi-function hairbrush with storage compartments 100 of the present invention showing detachable comb 122 in the open mode. FIG. 2B is a representative top view of an embodiment of the multi-function hairbrush with storage compartments 100 of the present invention showing storage compartment 116.

Figure 3:
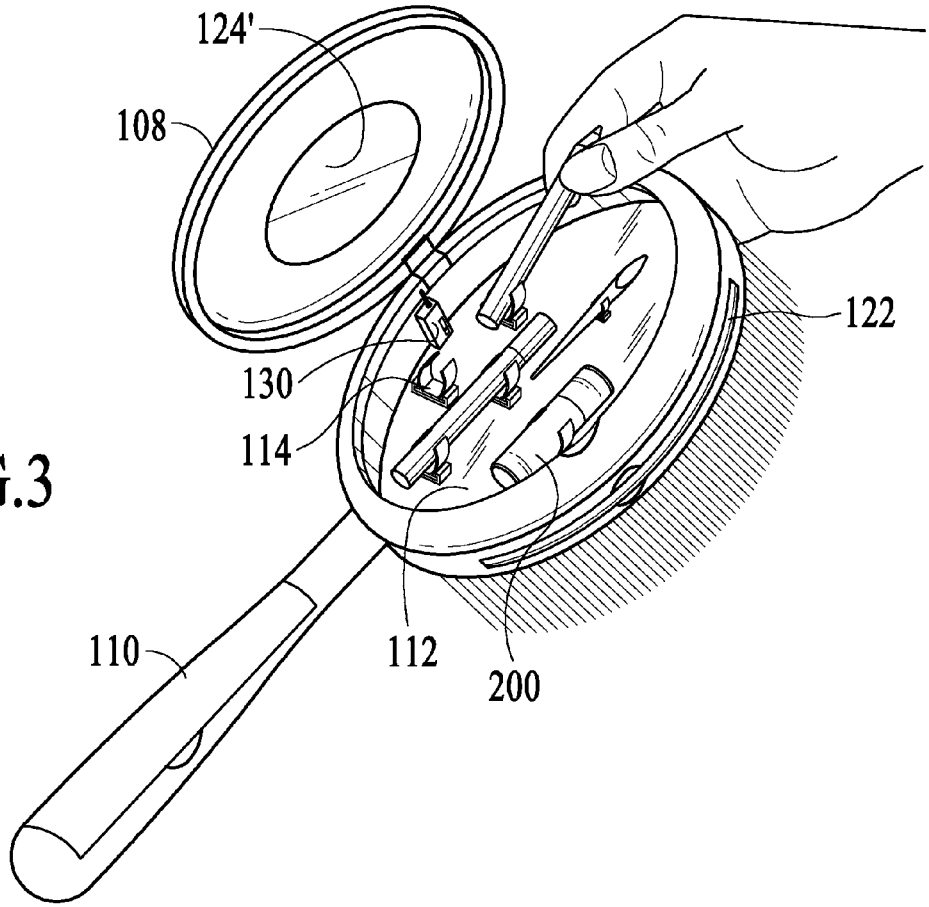
FIG. 3 is shows a method of use of an embodiment of the multi-function hairbrush with storage compartments 100 of the present invention.

FIG. 3 shows a method of use of an embodiment of the multi-function hairbrush with storage compartments 100 of the present invention and a representative isometric view of removable accessory clip 114. As shown, a user can arrange and organize their personal cosmetic and/or other grooming accessories in storage compartments 112 and 116 as he/she wishes. Stored objects 200 are supported in place by retaining clips 114 making them easily accessible when needed. The hairbrush of the present invention 100 can be used daily by students in any level of education, employees at the office or by workers in a manufacturing facility. The hairbrush 100 can also be used for camping or travel such as in hotels and on cruise ships, temporary and shared living situations, etc. Men and women can personalize their hairbrush 100 to contain exactly what they personally will need during the period of time during which they will be depending upon the device. The location of various accessories can be located as desired by placing the circlip 406./brackets 404 onto the mounting grips 402 in locations which accommodate the accessories of choice.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. A multi-functional hairbrush with storage compartments for grooming, storing and organizing small beauty accessories, the multi-functional hairbrush comprising:

a hollow brush head having an upper face and a lower face and an operatively-sized main chamber, the brush head further having brush bristles permanently mounted on the lower face, the brush head further having a brush lid portion attached hingedly on the upper face, the main chamber further having an inside, flat surface with a plurality of removable flange portions mounted therewithin, each of the plurality of removable flange portions having a pair of side, enclosing edges;

a slot chamber positioned underneath the main chamber, the slot chamber having an elongated slot opening, the slot chamber containing a flat comb portion fitting removably within the slot chamber;

a plurality of reattachable spring clip inserts removably coupled to the flange portions, the plurality of reattachable spring clip inserts each having a flat base portion with rectangular ends formed integrally to a spring clip portion, the plurality of reattachable springclip inserts coupling matingly and reattachably with the flange portions by sliding the rectangular ends of the insert portions of the spring clip inserts between the pair of side, enclosing edges of the flange portions in a direction parallel to the inside, flat surface upon which the plurality of removable flange portions are mounted, the spring clip inserts having a variety of sizes and clip openings for removably securing a plurality of accessories therewithin, wherein the arrangement of accessories can be personalized by removably coupling the reattachable spring clip inserts of different sizes to the flange portions in desired locations within the main chamber;

a hollow elongated handle portion having a proximal end and a distal end and an elongated chamber, the proximal end of the handle portion secured to the brush head, a handle lid portion attached hingedly to the handle portion, the elongated chamber having a plurality of the flange portions each with a pair of side, enclosing edges removably mounted therewithin, the spring clip inserts having a flat base portion and integrally-formed rectangular ends coupled removably to the flange portions by sliding the rectangular ends of the insert portions of the spring clip inserts between the pair of side, enclosing edges of the flange portions; and a music box movement mounted within the main chamber with a trigger which activates play of music when the brush lid is opened, the music box movement further having a permanent off switch to prevent music from being played every time the lid is opened.

2. The multi-functional hairbrush of claim 1 in which the brush head has a cross-sectional shape selected from the group consisting of oval, circular, square and rectangular.

3. The multi-functional hairbrush of claim 1 in which the brush lid portion has a mirror mounted thereon.

4. The multi-functional hairbrush of claim 1 in which the brush lid portion has a mirror mounted on a front side thereof and a back side thereof.

5. The multi-functional hairbrush of claim 1 in which the comb portion is attached hingedly to the slit chamber.

6. The multi-functional hairbrush of claim 1 in which the main chamber further has a bristle cover mounted removably over the lower face of the brush head.

7. The multi-functional hairbrush of claim 6 in which the bristle cover is made using transparent materials.

8. The multi-functional hairbrush of claim 1 in which the elongated handle portion has a cross-sectional shape selected from the group consisting of oval and rectangular.

9. A multi-functional hairbrush with storage compartments for grooming, storing and organizing small beauty accessories, the multi-functional hairbrush with storage compartments comprising a hollow brush head having an upper face and a lower face and a main chamber, the hairbrush further comprising a brush lid portion attached hingedly to the upper face of the hollow brush head, the main chamber further having a flat, inside surface with a plurality of mounted flange portions mounted reattachably and removably therewithin, a plurality of reattachable spring clip inserts removably coupled to the flange portions, the plurality of reattachable spring clip inserts each having a flat base portion with rectangular ends formed integrally to a spring clip portion, the plurality of reattachable springclip inserts coupling matingly and reattachably with the flange portions by sliding the rectangular ends of the insert portions of the spring clip inserts between the pair of side, enclosing edges of the flange portions in a direction parallel to the inside, flat surface upon which the plurality of removable flange portions are mounted, the hairbrush further comprising a slot chamber positioned underneath the main chamber, the hairbrush further comprising a flat comb portion fitting within the slot chamber and inserted removably therewithin, the hairbrush further comprising a hollow, elongated handle portion having a proximal end and a distal end and an elongated chamber, the proximal end of the handle portion secured to the brush head, the hairbrush further comprising a handle lid portion attached hingedly to the handle portion, the elongated chamber having a plurality of flange portions each with a pair of side, enclosing edges removably mounted within the elongated chamber, the hairbrush further containing spring clip inserts having a flat base portion and integrally-formed rectangular ends coupled removably to the flange portions by sliding the rectangular ends of the insert portions of the spring clip inserts between the pair of side, enclosing edges of the flange portions, wherein the arrangement of accessories can be personalized by removably coupling the reattachable spring clip inserts of different sizes to the flange portions in desired locations within the main chamber, the hairbrush further comprising a music box movement mounted within the main chamber with a trigger which activates play of music when the brush lid is opened, the music box movement further having a permanent off switch to prevent music from being played every time the lid is opened.

* * * * *